US007077673B2

(12) United States Patent
Uchida et al.

(10) Patent No.: US 7,077,673 B2
(45) Date of Patent: Jul. 18, 2006

(54) CONNECTOR, SEALED CASE WITH CONNECTOR, AND MODULE WITH CONNECTOR

(75) Inventors: Yoshihide Uchida, Okayama (JP); Takayuki Hori, Aichi (JP); Takahiro Shibaya, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/898,995

(22) Filed: Jul. 27, 2004

(65) Prior Publication Data

US 2005/0059282 A1 Mar. 17, 2005

(30) Foreign Application Priority Data

Jul. 29, 2003 (JP) ..... 2003-203265

(51) Int. Cl.
*H01R 4/60* (2006.01)

(52) U.S. Cl. ..... 439/206

(58) Field of Classification Search ..... 439/205, 439/206

See application file for complete search history.

(56) References Cited

U.S. PATENT DOCUMENTS 4,828,507 A * 5/1989 Nagase et al. ..... 439/206
5,447,445 A * 9/1995 Torii et al. ..... 439/271

FOREIGN PATENT DOCUMENTS

| | | | |
|---|---|---|---|
| EP | 1075849 | A2 * | 2/2001 |
| JP | 2000-003753 | A | 1/2000 |
| JP | 2000-228243 | A | 8/2000 |
| JP | 2001-155814 | A | 6/2001 |
| JP | 2001-196770 | A | 7/2001 |
| JP | 2002-134215 | A | 5/2002 |

* cited by examiner

*Primary Examiner*—Briggitte R. Hammond
(74) *Attorney, Agent, or Firm*—Rader, Fishman & Grauer PLLC

(57) ABSTRACT

A connector including: a male connector having a generally-box-shaped first housing and a first connection terminal; and a female connector having a generally-box-shaped second housing and a second connection terminal. The second housing has an airway for allowing the second housing inside to communicate with the outside. The first connection terminal has a communicating path for allowing the first housing inside to communicate with the outside. Because the inside of the sealed case and connector can be opened to the atmosphere through the communicating paths, the internal pressure of the sealed case can be brought into a condition close to or agreement with the atmospheric pressure. Even when temperature variations rapidly change the internal pressure of the sealed case, cracking in the sealed case can be avoided because internal pressure changes in the sealed case can be relieved.

4 Claims, 12 Drawing Sheets

CONNECTOR, SEALED CASE WITH CONNECTOR, AND MODULE WITH CONNECTOR

CROSS-REFERENCE TO RELATED APPLICATIONS

This application is based upon and claims the benefit of priority from the prior Japanese Patent Application No. 2003-203265 filed on Jul. 29, 2003, the entire contents of which is incorporated herein by reference.

FIELD OF THE INVENTION

The present invention relates to a connector which can be fixed to a sealed case, for example. More specifically, the invention relates to a connector, a sealed case with a connector, and a module with a connector, which are especially suitable for use in electronic equipment having electronics and a sealed case for protecting the electronics and used under a condition such that a relatively large change in temperature occurs.

BACKGROUND OF THE INVENTION

Conventionally, electronics, for example, used in ships, aircraft, motor vehicles, etc. are housed in the respective waterproof cases in order to prevent water from entering the their insides when they are used under conditions such that they are exposed to rainwater or moisture. The waterproof cases are each provided with a connector, through which the above-described electronics receive/transmit electric signals from/to the outside thereof.

Moreover, a waterproof case like that is often placed under a condition such that a relatively large change in temperature occurs. Therefore, when the changes from a high temperature to a low temperature and a low temperature to a high temperature are repeated, the waterproof case can be cracked and degraded in water-resistance.

In other words, a temperature change causes a pressure difference between an internal pressure of the waterproof case and the atmospheric pressure, thereby deforming the waterproof case. Such deformation is repeated, while the waterproof case is cracked.

Then, in order to solve the problem, it has been proposed a method of opening the inside of the waterproof case to the atmosphere thereby to keep the inside of the waterproof case at a pressure substantially equal to an atmospheric pressure (see JP-A-2000-228243).

More concretely, the waterproof case has a connector fixed on its side surface and the connector is connected to the circuit board inside the waterproof case. Also, the waterproof case has a communicating path formed therein to keep the inside of the waterproof case in communication with the inside of the connector. To the connector, an external connector is to be coupled. The external connector has a ventilating hole formed therein to open the connector inside to the atmosphere.

According to the configuration, the external connector is connected with the connector fixed on the waterproof case, whereby pressures of the insides of the connector and the waterproof case can be substantially conformed to the atmospheric pressure.

However, the above-described method, by which a through-hole for allowing a connection terminal to pass through the case is formed in the waterproof case, involves the formation of a communicating path other than the through-hole and as such, the manufacturing process of the case is made more complicated.

In addition, because the external connector may be exposed rainwater or moisture, it is required to ensure the water-resistance of the ventilating hole formed in the external connector. On this account, it is required to actually install a special water-repellent filter having both air permeability and water-resistance on the ventilating hole. As a result, the conventional ventilating method for a waterproof case not only involves a special member but also makes the manufacturing process more complicated and raises the costs.

Again, while a through-hole for allowing a connection terminal to pass through the case is formed in the waterproof case, it is necessary to form a communicating path in addition to the through-hole and as such, the manufacturing process of the case is made more complicated.

Moreover, a waterproof case like this has been formed from a high-strength metal traditionally, whereas attempts to form such waterproof case from a resin, which is wieldy and excellent cost wise, have been made in recent years. A waterproof case made from a resin is prone to be cracked owing to temperature changes. Therefore, it becomes increasingly important to substantially conform pressures of the insides of the connector and the waterproof case to the atmospheric pressure thereby to prevent the occurrence of a crack.

SUMMARY OF THE INVENTION

The invention was made in light of such current realities. It is an object of the invention to provide a connector, a sealed case with a connector, and a module with a connector, which are capable of preventing the occurrence of a crack even when the internal pressure of the sealed case is changed sharply owing to temperature changes and which allows the manufacturing cost to be reduced.

As a result of wholehearted studies accumulated in order to attain the object, the inventor has focused attention on that providing a communicating path in a connection terminal to pierce a waterproof case can eliminate the need for additionally forming a communicating path.

Also, the inventor has focused attention on that when an airway for allowing the air to flow is provided in an electric wire to be connected to the female connector, the inside of the waterproof case can be opened to the atmosphere through the airway.

Therefore, the invention provides a connector, sealed case with connector, and module with connector, described in (1) to (10) below.

(1) A connector comprising: a male connector having a generally-box-shaped first housing with an opening formed in its distal end portion, and a first connection terminal provided inside said first housing; a female connector having a generally-box-shaped second housing with an opening formed in its distal end portion , and a cylindrical second connection terminal provided inside said second housing; wherein said second housing has an airway for allowing the inside of said second housing to communicate with the outside; wherein said first connection terminal has a communicating path formed therein for allowing the inside of said first housing for communicating with the outside; and whereby said first housing is inserted in said second housing so that said first connection terminal is inserted in said second connection terminal, and said male connector is connected with said female connector.

According to the connector described in (1), the first housing is put inside the second housing, for example, in the condition where the male connector has been fixed to a sealed case. Then, the first connection terminal is inserted in the second connection terminal, thereby connecting the male connector with the female connector. In this time, a sealed space cut off from the outside is defined inside the connector. The sealed space communicates through the communicating paths with the inside of the sealed case.

Therefore, the inside of the sealed case and the inside of the connector can be opened to the atmosphere through communicating paths and as such, the internal pressure of the sealed case can be brought into a condition close to or agreement with the atmospheric pressure. Accordingly, even when temperature changes cause rapid changes of the internal pressure of the sealed case, the occurrence of a crack in the sealed case can be prevented because the changes of the internal pressure of the sealed case can be relieved.

Moreover, since communicating paths for allowing the inside of the first housing to communicate with the outside are formed in the first connection terminal, the need for additionally providing a communicating path in the first housing is eliminated and therefore the manufacturing cost can be reduced.

(2) The connector described in (1), wherein said female connector comprises an electric wire for being connected with said second connection terminal, and wherein said communicating path is provided inside said electric wire.

According to the connector described in (2), electric wire is connected to the female connector, and an airway for allowing the inside of the second housing to communicate with a proximal end portion of the electric wire is provided inside the electric wire. Thus, simply opening the proximal end side of the electric wire to the atmosphere can open the inside of the sealed case as well as the inside of the connector to the atmosphere through the airways. On this account, the internal pressure of the sealed case can be brought into a condition close to or agreement with the atmospheric pressure. Accordingly, even when temperature changes cause rapid changes of the internal pressure of the sealed case, the occurrence of a crack in the sealed case can be prevented because the changes of the internal pressure of the sealed case can be relieved.

(3) The connector described in (2), wherein said electric wire comprises a core wire and a water-resistant cover tube for covering the core wire, and wherein said airway extends along the core wire inside the cover tube.

(4) A sealed case with a connector comprising: a sealed case; a male connector provided integrally with said sealed case; a female connector for being connected with said male connector; wherein said male connector having a generally-box-shaped first housing with an opening formed in its distal end portion, and a first connection terminal provided inside said first housing; wherein said female connector having a generally-box-shaped second housing with an opening formed in its distal end portion , and a cylindrical second connection terminal provided inside said second housing; wherein said second housing has an airway allowing the inside of said second housing to communicate with the outside; wherein said first connection terminal has a communicating path formed therein for allowing the inside of said sealed case for communicating with the inside of said first housing; and whereby said first housing is inserted in said second housing so that said first connection terminal is inserted in said second connection terminal, and said male connector is connected with said female connector.

According to the sealed case with a connector described in (4), the first housing is put inside the second housing. Then, the first connection terminal is inserted in the second connection terminal, thereby connecting the male connector with the female connector. In this time, a sealed space cut off from the outside is defined inside the connector. The sealed space communicates with the inside of the sealed case through the communicating paths.

As a result, the inside of the sealed case and the inside of the connector can be opened to the atmosphere through the communicating paths and as such, the internal pressure of the sealed case can be brought into a condition close to or agreement with the atmospheric pressure. Accordingly, even when temperature changes cause rapid changes of the internal pressure of the sealed case, the occurrence of a crack in the sealed case can be prevented because the changes of the internal pressure of the sealed case can be relieved.

Moreover, since communicating paths for allowing the inside of the first housing to communicate with the outside are formed in the first connection terminal, the need for additionally providing a communicating path in the first housing is eliminated and therefore the manufacturing cost can be reduced.

In addition, since the first housing and the sealed case are formed into one piece, the occurrence of a crack can be prevented more reliably even when the connector is formed from a material lower in strength.

(5) The sealed case with a connector described in (4), wherein said female connector comprises an electric wire for being connected with said second connection terminal, and wherein said communicating path is provided inside said electric wire.

According to the sealed case with a connector described in (5), the electric wire is connected to the female connector and an airway for allowing the inside of the second housing to communicate with a proximal end portion of the electric wire is provided inside the electric wire. Thus, simply opening the proximal end side of the electric wire to the atmosphere can open the inside of the sealed case as well as the inside of the connector to the atmosphere through the airways. On this account, the internal pressure of the sealed case can be brought into a condition close to or agreement with the atmospheric pressure. Accordingly, even when temperature changes cause rapid changes of the internal pressure of the sealed case, the occurrence of a crack in the sealed case can be prevented because the changes of the internal pressure of the sealed case can be relieved.

(6) The sealed case with a connector described in (5), wherein said electric wire includes a core wire, and a water-resistant cover tube for covering the core wire, and wherein said airway extends along the core wire inside the cover tube.

(7) A module with a connector comprising: a sealed case; a male connector provided on said sealed case; a female connector for being connected with said male connector; wherein said male connector having a generally-box-shaped first housing with an opening formed in its distal end portion, and first connection terminal provided inside said first housing; wherein said female connector having a generally-box-shaped second housing with an opening formed in its distal end portion, and cylindrical second connection terminal provided inside said second housing; wherein said second housing has an airway allowing the inside of said second housing to communicate with the outside; wherein said first connection terminal has a communicating path formed therein for allowing the inside of said sealed case for communicating with the inside of said first housing; and whereby said first housing is inserted in said second housing so that said first connection terminal is inserted in said second connection terminal, and said male connector is connected with said female connector.

According to the module with a connector described in (7), the first housing is put inside the second housing. Then, the first connection terminal is inserted in the second connection terminal, thereby connecting the male connector with the female connector. In this time, a sealed space cut off from the outside is defined inside the connector. The sealed space communicates with the inside of the sealed case through the communicating paths.

Therefore, the inside of the sealed case and the inside of the connector can be opened to the atmosphere through communicating paths and as such, the internal pressure of the sealed case can be brought into a condition close to or agreement with the atmospheric pressure. Accordingly, even when temperature changes cause rapid changes of the internal pressure of the sealed case, the occurrence of a crack in the sealed case can be prevented because the changes of the internal pressure of the sealed case can be relieved.

Moreover, since communicating paths for allowing the inside of the first housing to communicate with the outside are formed in the first connection terminal, the need for additionally providing a communicating path in the first housing is eliminated and therefore the manufacturing cost can be reduced.

(8) The module with a connector described in (7), wherein said female connector comprises an electric wire for being connected with said second connection terminal, and wherein said communicating path is provided inside said electric wire.

According to the module with a connector described in (8), electric wire is connected to the female connector, and an airway for allowing the inside of the second housing to communicate with a proximal end portion of the electric wire is provided inside the electric wire. Thus, simply opening the proximal end side of the electric wire to the atmosphere can open the inside of the sealed case as well as the inside of the connector to the atmosphere through the airways. On this account, the internal pressure of the sealed case can be brought into a condition close to or agreement with the atmospheric pressure. Accordingly, even when temperature changes cause rapid changes of the internal pressure of the sealed case, the occurrence of a crack in the sealed case can be prevented because the changes of the internal pressure of the sealed case can be relieved.

(9) The module with a connector described in (8), wherein said electric wire includes a core wire, and a water-resistant cover tube for covering the core wire, and said airway extends along the core wire inside the cover tube.

(10) The module with a connector described in any one of (7) to (9), wherein the first housing of the male connector is formed integrally with said sealed case.

According to the module with a connector described in (10), since the first housing and the sealed case are formed into one piece, the occurrence of a crack can be prevented more reliably even when the connector is formed from a material lower in strength.

DETAILED DESCRIPTION OF THE PREFERRED EMBODIMENT

Figure 1A:
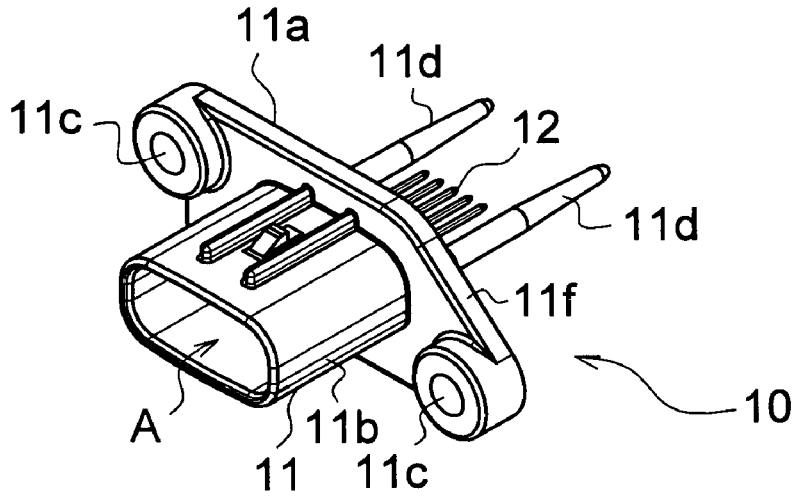
FIG. 1A is a perspective view of a male connector which configures a connector according to the first embodiment of the invention.

The embodiments of the invention will be described below in reference to the drawings. In the description below, like constitutive elements are identified by the same reference character and the description thereof is omitted or simplified.

First Embodiment

Figure 1B:
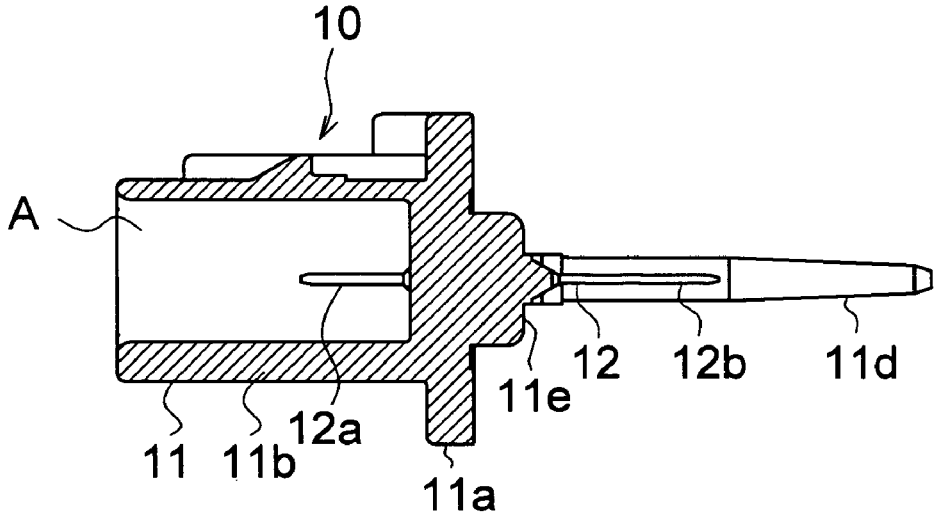
FIG. 1B is a sectional view of the male connector according to the embodiment.

FIG. 1A is a perspective view of a male connector 10 included by a connector according to the embodiment. FIG. 1B is a sectional view of the male connector 10.

The connector includes a male connector 10 and a female connector 20 to be connected with the male connector 10.

The male connector 10 includes: a generally-box-shaped first housing 11 which is made of a resin and which has an opening formed in its distal end portion; and five first connection terminals 12 provided inside the first housing 11.

The first housing 11 is configured of an elliptic cylinder body 11*b* and a bottom wall 11*a* closing one end of the elliptic cylinder body 11*b*. Inside the housing 11, there is defined an interior space A.

The bottom wall 11*a* includes: a thickly-shaped portion 11*e* having a larger thickness and closing the elliptic cylinder body 11*b*; and a collar portion 11*f* extending from the thickly-shaped portion 11*e* like a collar. In both ends of the collar portion 11*f*, threaded holes 11*c* are formed. A fixing screw for fixing the male connector 10 to a waterproof case 100 as a sealed case, which is described later, is to be inserted into each threaded hole 11*c*.

In both ends of the thickly-shaped portion 11*e* of the bottom wall 11*a*, there are formed a pair of fixing pins 11*d* having a rod shape and protruding outwardly. The fixing pins 11*d* are provided so that the first connection terminals 12 are placed therebetween, and the fixing pins extend substantially in parallel with the first connection terminals 12. The pair of fixing pins 11*d* is used to position the male connector 10 with respect to the waterproof case 100 to be described later.

The first connection terminals 12, which are rod-like members made of a metal, pierce the thickly-shaped portion 11*e* of the housing 11 and are secured to the housing.

The distal end portion 12*a* of each first connection terminal 12 is exposed to the interior space A of the housing 11, whereas the proximal end portion 12*b* is exposed to the outside of the housing 11. The proximal end portion 12*b* of the first connection terminal 12 is connected with a circuit board accommodated in the waterproof case 100.

Figure 2:
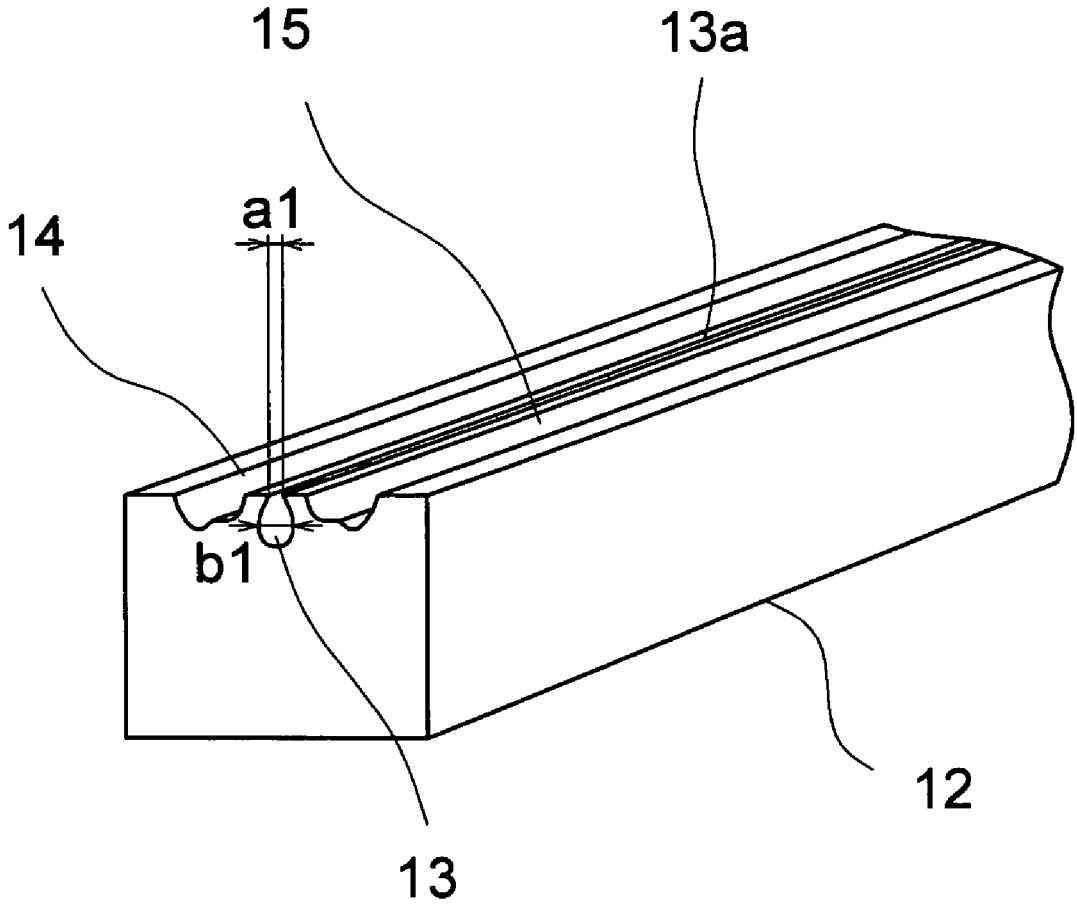
FIG. 2 is an enlarged perspective view of a first connection terminal according to the embodiment.

FIG. 2 is an enlarged perspective view of the first connection terminal 12.

The first connection terminal 12 is in a rod-like shape with a generally-square cross section (e.g. of a size of 0.6 mm×0.6 mm).

The first connection terminal has a groove-like communicating path 13 extending along the longitudinal direction of the terminal and channels 14, 15 extending on both the sides of the communicating path 13. The width of the communicating path 13, which is a1 at the level of a surface of the first connection terminal 12, becomes wider as it is at a deeper level, and reaches a maximum of b1.

The channels 14, 15 are used to form the communicating path 13 in a process of manufacturing the first connection terminal 12, which is to be described later.

In a step of shaping the housing 11, the first connection terminals 12 are previously arranged in a die to perform injection molding and as such, a molten resin can flow into the communicating path 13 to clog up the communicating path 13. Therefore, the width al of the communicating path 13 at the level of the surface of the first connection terminal 12 may be of a size such that even when a molten resin flows into the communicating path 13, clogging of the communicating path 13 by the molten resin flowing into the communicating path 13 can be avoided.

Thus, the width a1 can be appropriately set according to molding conditions, such as ingredients, a viscosity and a temperature of the molten resin used for molding of the housing 11, a filling pressure of the molten resin, and the locational relation between the filling location of the die and the communicating path 13.

For example, in the case where a resin with a filler added thereto, such as a glass fiber, is used to perform the injection molding of the housing 11, the width a1 of the communicating path 13 can be set to be relatively wide.

The above-described first connection terminals 12 are manufactured according to, for example, the following procedures.

Figure 3A:
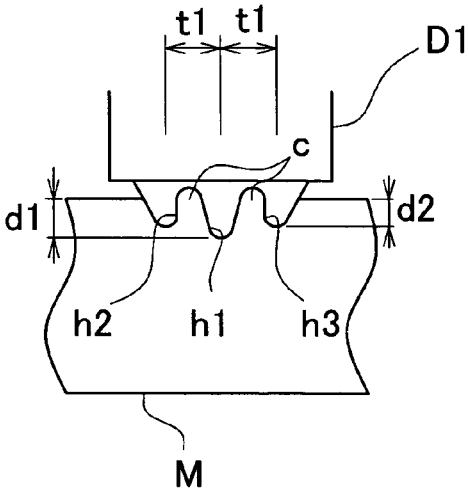
FIG. 3A is a side view showing the situation where grooves are formed in a metal plate by a procedure for manufacturing the first connection terminal according to the embodiment.

First, as shown in FIG. 3A, a die D1 with three protrusions formed in parallel is prepared, each protrusion having the general shape of a triangle in cross section. The die D1 is pressed against a metal plate M. As a result of the punching (press working), in the metal plate M are formed at given intervals t1: a groove h1 having the general shape of an inverted triangle in cross section, i.e. having a width that narrows with an increase in depth, and having a depth of d1; and grooves h2, h3, which extend on the sides of the groove h1 and have the general shape of a triangle in cross section and a depth of d2. Here, a pair of walls c is formed on both the sides of the groove h1 of the metal plate M.

More concretely, the interval t1 is 0.15 mm, for example. Further, the depth d1 of the groove h1 is, for example, 0.1 mm, and the depths d2 of the grooves h2, h3 are, for example, 0.07 mm.

Figure 3B:
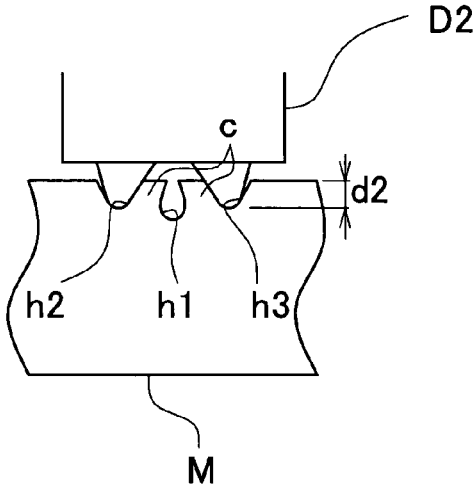
FIG. 3B is a side view showing the situation where the grooves formed in the metal plate are narrowed in width by a procedure for manufacturing the first connection terminal according to the embodiment.

Then, as shown in FIG. 3B, a die D2, in which two protrusions of the general shape of a right-angled triangle in cross section are formed in parallel, is prepared. The protrusions of the die D2 are pressed against the grooves h2, h3 of the metal plate M. This makes the paired walls c inclined toward the groove h1, thereby narrowing the width of the groove h1.

Figure 3C:
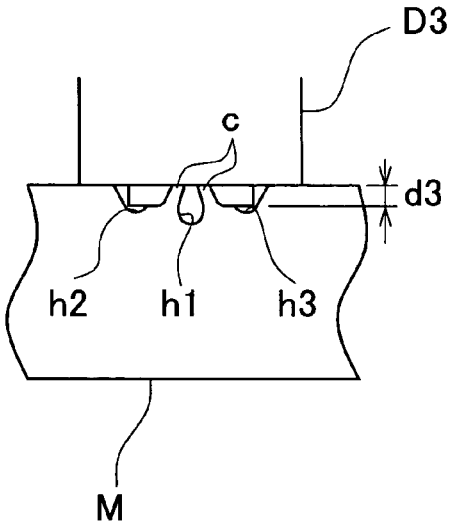
FIG. 3C is a side view showing the situation where the grooves formed in the metal plate are further narrowed by a procedure for manufacturing the first connection terminal according to the embodiment.

Subsequently, as shown in FIG. 3C, a die D3, in which two protrusions of the general shape of a trapezoid in cross section are formed in parallel, is prepared. The protrusions of the die D3 are pressed against the grooves h2, h3. This makes upper portions of the paired walls c further inclined toward the groove h1 within a range from a surface of the metal plate M up to a depth of d3 (e.g. 0.05 mm), thereby further narrowing the width of the groove h1.

Figure 3D:
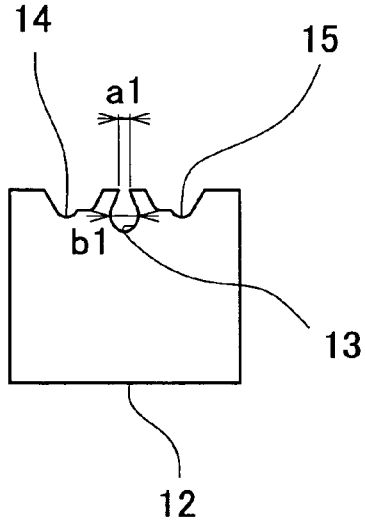
FIG. 3D is a side view of the first connection terminal according to the embodiment.

Then, the metal plate M is cut into the shape of a quadratic prism with the grooves h1 to h3. Thus, the first connection terminal 12 is formed, in which the groove h1 makes the communicating path 13 and the grooves h2, h3 make the channels 14, 15, as shown in FIG. 3D. More concretely, the first connection terminal 12 has one edge of, for example, 0.60 mm, and the communicating path 13 measures, for example, 0.02 mm in the width a1 and 0.04 mm in the width b1.

The width b1 of the communicating path 13 is preferably 0.01 mm or longer. In addition, the communicating path 13 isn't necessarily formed along the entire length of the first connection terminal 12 and it may be formed in a part of the terminal piercing the bottom wall 11*a* of the housing 11.

The housing 11 of such male connector 10 can be manufactured by so-called injection molding. More specifically, the first connection terminals 12 are arranged in the die, and in this situation a resin is filled into the die thereby to form the housing 11. This isn't necessarily the best way, and the housing 11 may be manufactured by: forming a through-hole in the bottom wall 11*a* of the housing 11 by injection molding; and thereafter press-fitting the first connection terminals 12 into the through-hole.

Figure 4A:
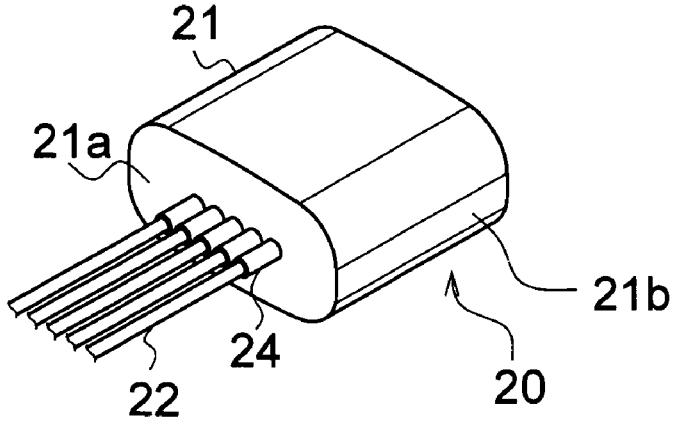
FIG. 4A is a perspective view of a female connector according to the embodiment.
Figure 4B:
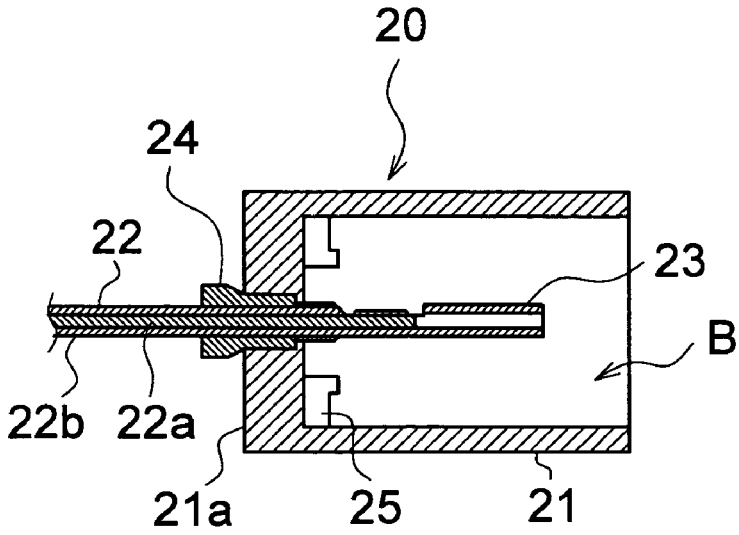
FIG. 4B is a sectional view of the female connector according to the embodiment.

FIG. 4A is a perspective view of a female connector 20 included by the connector according to the embodiment. FIG. 4B is a sectional view of the female connector 20.

The female connector 20 includes a generally-box-shaped second housing 21 which is made of a resin and which has an opening formed in its distal end portion; five second connection terminals 23 provided inside the second housing 21; and electric wires 22 connected with the second connection terminals 23.

The second housing 21 is configured of an elliptic cylinder body 21*b* and a bottom wall 21*a* closing one end of the elliptic cylinder body 21*b*. Inside the housing 21, there is defined an interior space B.

The bottom wall 21*a* has a plurality of through-holes formed at given intervals; the through-holes are threaded with the electric wires 22 respectively. Between the through-hole and electric wire 22, there is fitted a cylindrical rubber stopper 24 as a sealing member for sealing the through-hole.

Also, a ring-shaped rubber stopper 25 is fitted in the interior space B of the bottom wall 21*a*.

Figure 5A:
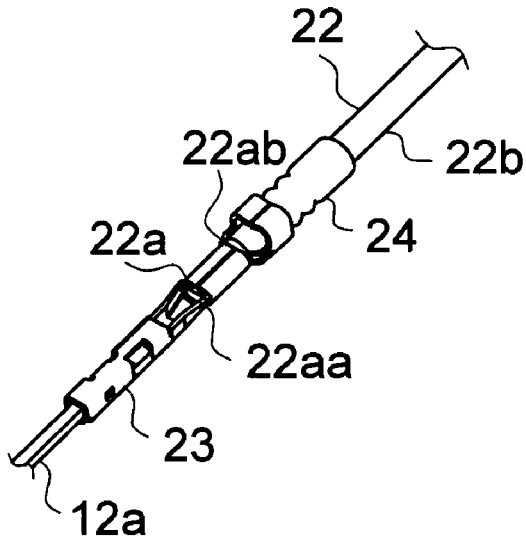
FIG. 5A is an enlarged perspective view showing a connected position of the first and second connection terminals according to the embodiment.
Figure 5B:
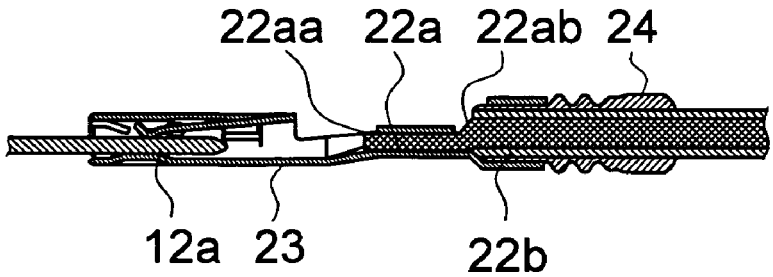
FIG. 5B is a sectional view showing the connected position of the first and second connection terminals according to the embodiment.
Figure 6:
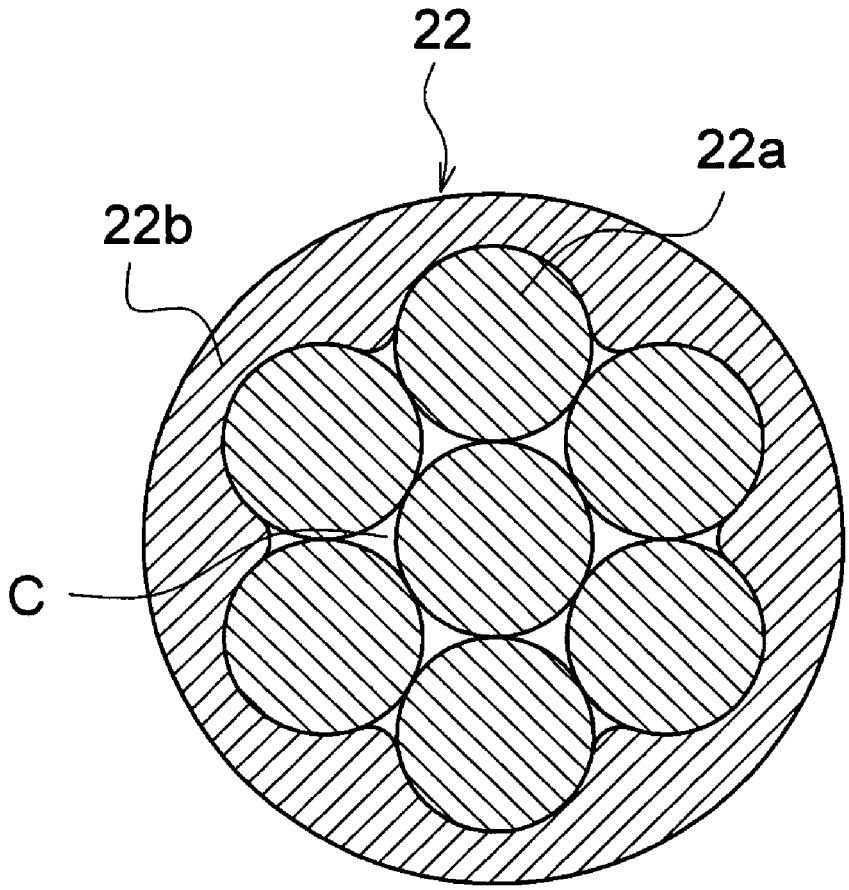
FIG. 6 is a sectional view of an electric wire 22 according to the embodiment.

FIGS. 5A and 5B are an enlarged perspective view and a sectional view respectively, both showing a connected position of the first connection terminal 12 and the second connection terminal 23. In addition, FIG. 6 is a sectional view of the electric wire 22.

The second connection terminal 23 is formed by working a metal sheet material in to a general cylinder form. Connecting the male connector 10 and the female connector 20 causes the distal end portion 12*a* of the first connection terminal 12 to be inserted in the second connection terminal 23.

The electric wire 22 has a core wire 22*a*, a water-resistant cover tube 22*b* for covering the core wire 22*a*, and an airway C provided inside the cover tube 22*b*.

The core wire 22*a* is formed by twisting a plurality of metallic wires together. This isn't necessarily the best way, and the core wire may be formed by a length of metallic wire.

The airway C is a gap formed between the core wire 22*a* and the cover tube 22*b*. The airway C extends along the entire length of the cover tube 22*b* and communicates both the ends of the cover tube 22*b*.

The distal end portion of the electric wire 22 is stripped of the cover tube 22*b* and thus the core wire 22*a* is exposed there. The exposed core wire 22*a* is put inside the proximal end portion of the second connection terminal 23 and squeezed thereby to connect the electric wire 22 with the second connection terminal 23. In this situation, side portions 22*aa* and 22*ab* of the core wire 22*a* are exposed from the squeezed portion of the second connection terminal 23.

Also, the electric wire 22 is squeezed by the above-described rubber stopper 24 on the side of the proximal end portion of the second connection terminal 23.

The housing 21 of such female connector 20 can be manufactured by so-called injection molding. More specifically, each of the second connection terminals 23 is connected with the electric wire 22 and the rubber stopper 24 is fitted thereon, and in this situation the second connection terminals 23 are arranged in the die. Thereafter, a resin is filled into the die thereby to form the housing 21.

However, this isn't necessarily the best way, and a method according to the following procedures is also possible: first, molding the housing 21 by the injection technique; second, forcing the electric wire 22 to pierce through the housing 21; third, connecting the electric wire 22 with the second connection terminal 23; and fourth, fitting the rubber stopper 24 thereon.

Figure 7:
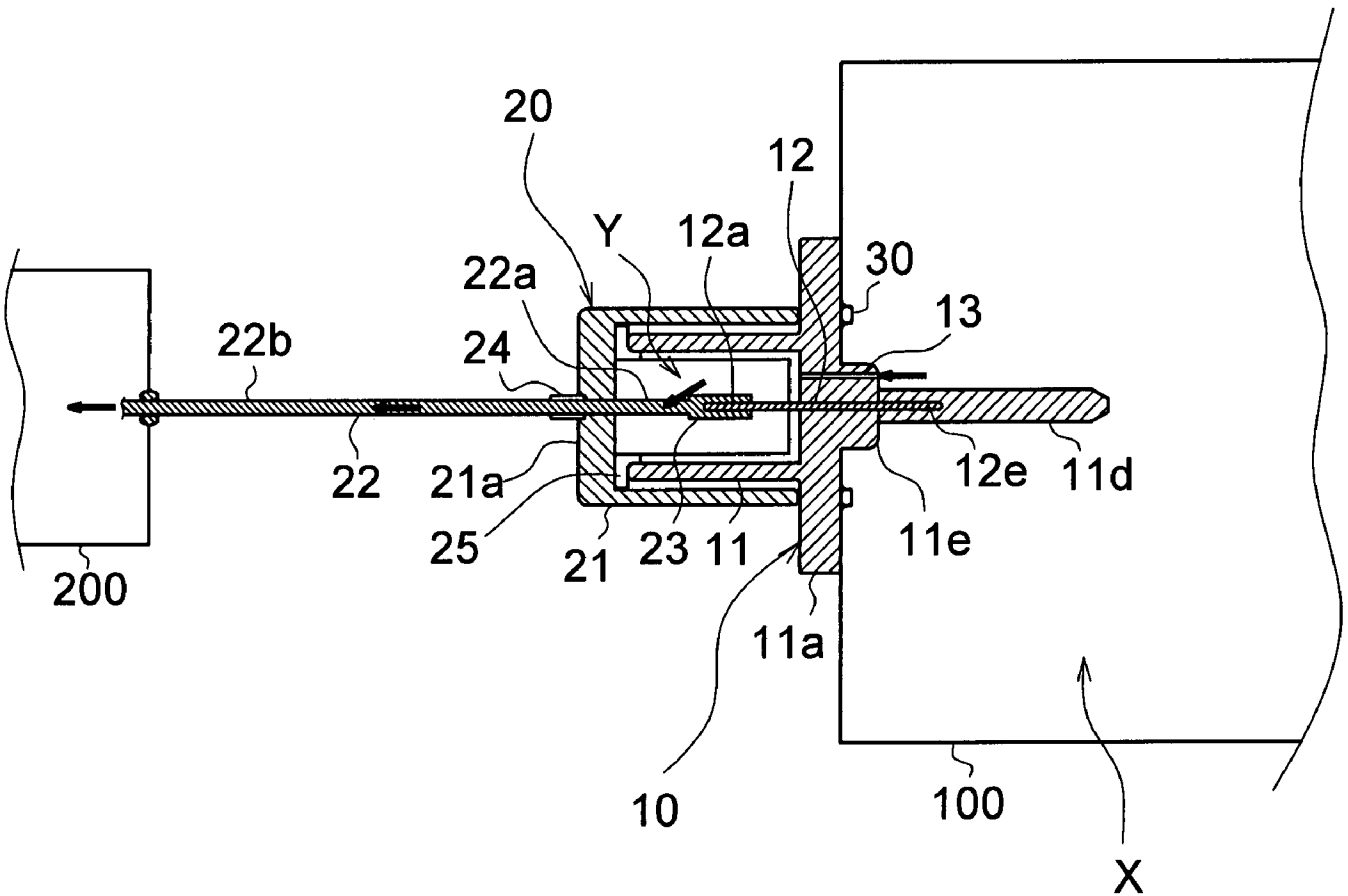
FIG. 7 is a sectional view showing the situation where a connector according to the embodiment is fixed to a sealed case.

FIG. 7 is a sectional view showing a situation where the connector is fixed to the waterproof case 100.

The waterproof case 100 is made of a resin and shaped like a box, and has an interior space X. The interior space X of the waterproof case 100 accommodates a circuit board (not shown). The male connector 10 is fixed on a sidewall of the waterproof case 100. Between the bottom wall 11*a* of the male connector 10 and the sidewall of the waterproof case 100, there is provided a ring-shaped rubber stopper 30 as a sealing member so as to surround the thickly-shaped portion 11*e*.

The male connector 10 is fixed to the waterproof case according to the procedures to be described below. That is, the fixing pins 11*d* of the male connector 10 are engaged in the respective fixing holes formed in the waterproof case 100. Concurrently, the thickly-shaped portion 11*e* of housing 11 of the male connector 10 is fitted in an opening portion of the waterproof case 100. Thereafter, a pair of fixing screws are threaded through the threaded holes 11*c* of the male connector 10 and screwed into the side wall of the waterproof case 100.

When the male connector 10 is fixed to the waterproof case 100 in this manner, the interior space X of the waterproof case 100 can communicate through the communicating paths 13 piercing the thickly-shaped portion 11*e* of the male connector 10 with the interior space A of the male connector 10.

The works of the connector is as follows.

The first housing 11 of the male connector 10 is put inside the second housing 21 of the female connector 20. Then, distal end portion s 12*a* of the first connection terminals 12 are inserted in the second connection terminals 23 thereby to connect the male connector 10 and the female connector 20.

In this situation, the gap between the opening of the male connector 10 and the bottom wall 21*a* of the female connector 20 is sealed by the rubber stopper 25, and the gap between the electric wire 22 and the bottom wall 21*a* of the female connector 20 is sealed by the rubber stopper 24. Thus, a sealed space Y cut off from the outside is defined inside the connector.

In the sealed space Y the side portions 22*aa*, 22*ab* of the core wire 22*a* are exposed (see FIG. 7) and as such, the sealed space Y communicates through the airway C adjacent to the core wire 22*a* with the inside of a case 200 having another control circuit provided therein.

Therefore, the embodiment has the following advantages.

There is provided an airway C inside the cover tube 22*b* of each electric wire 22, and therefore simply opening the proximal end side of the electric wires 22 to the atmosphere can open the inside of the waterproof case 100 as well as the inside of the connector to the atmosphere through the airways C and the communicating paths 13. Thus, the internal pressure of the waterproof case 100 can be brought into a condition close to or agreement with the atmospheric pressure. Accordingly, even when temperature changes cause rapid changes of the internal pressure of the waterproof case 100, the occurrence of a crack in the waterproof case 100 can be prevented because the changes of the internal pressure of the waterproof case 100 can be relieved.

While a stranded wire has been used to form the core wire 22*a* of the electric wire 22 in the first embodiment, a solid wire may be used to form the core wire instead of the stranded wire.

Further, the first housing 11 of the male connector 10 and the waterproof case 100 are separate structures in the first embodiment, however the first housing and the waterproof case may be formed into one piece instead. In this case, the occurrence of a crack can be prevented more reliably even when the connector is formed from a resin lower in strength than a metal.

Second Embodiment

Figure 8A:
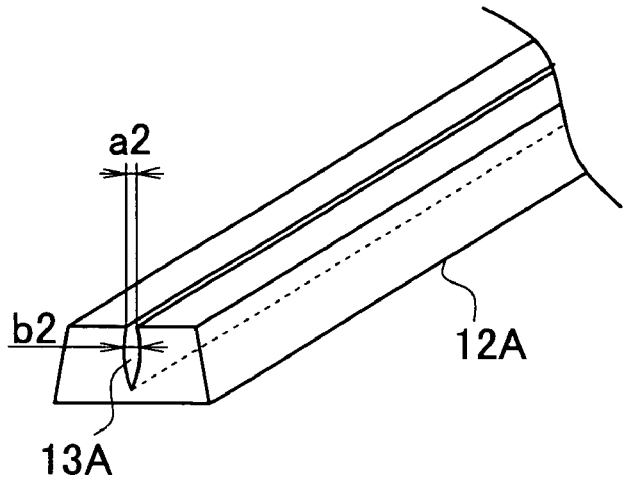
FIG. 8A is a perspective view of a first connection terminal included by a male connector according to the second embodiment of the invention.

FIG. 8A is a perspective view of each of first connection terminals 12A included by a male connector 10 according to the second embodiment.

The embodiment differs from the first embodiment in the structure of the first connection terminals 12A. More specifically, each of the first connection terminals 12A is generally shaped like a rod and has the general shape of a trapezoid in cross section. In the first connection terminal 12A, there is formed a groove-like communicating path 13A extending along its longitudinal direction. The width of the communicating path 13A, which is a2 at the level of a surface of the first connection terminal 12A, becomes wider as it is at a deeper level, and reaches a maximum of b2.

The above-described first connection terminal 12A can be manufactured according to the following procedures, for example.

Figure 8B:
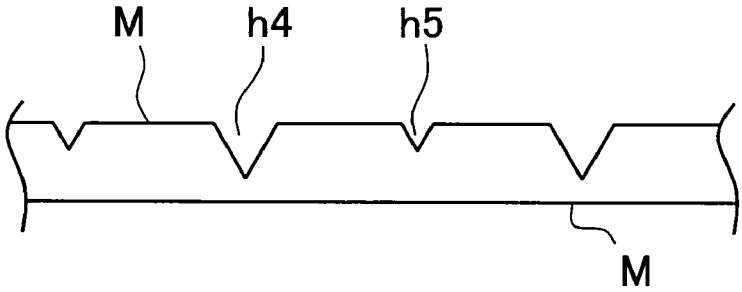
FIG. 8B is a side view showing the situation where grooves are formed in a metal plate by a procedure for manufacturing the first connection terminal according to the embodiment.

First, as shown in FIG. 8B, a groove h4 having the general shape of V in cross section and a groove h5 having the general shape of V in cross section, which is smaller than the groove h4, are provided in a surface of a metal plate M alternately at given intervals by punching (press working), cutting, etching, or the like.

Figure 8C:
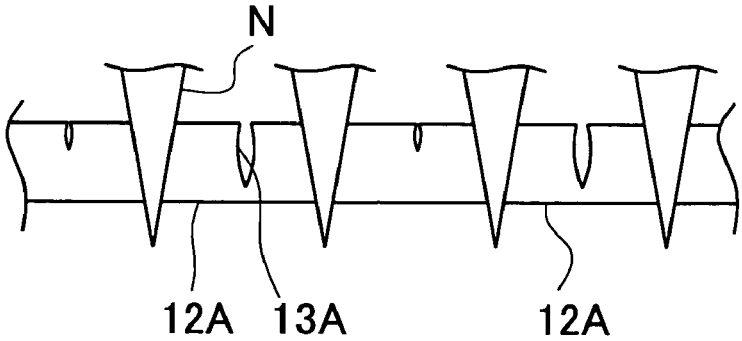
FIG. 8C is a side view showing the situation where the metal plate is cut into pieces by a procedure for manufacturing the first connection terminal according to the embodiment.

Next, as shown in FIG. 8C, a cutting blade N is pressed against the metal plate M between the grooves h4, h5 thereby to cut the metal plate M while narrowing the widths of the grooves h4, h5.

The first connection terminal 12A is thus formed, in which the groove h4 makes the communicating path 13A, and the grooves h2, h3 make the channels 14, 15.

The groove h6 of the first connection terminal 12A is generally V-shaped in cross section in the second embodiment. However, this isn't necessarily the best way.

Figure 9A:
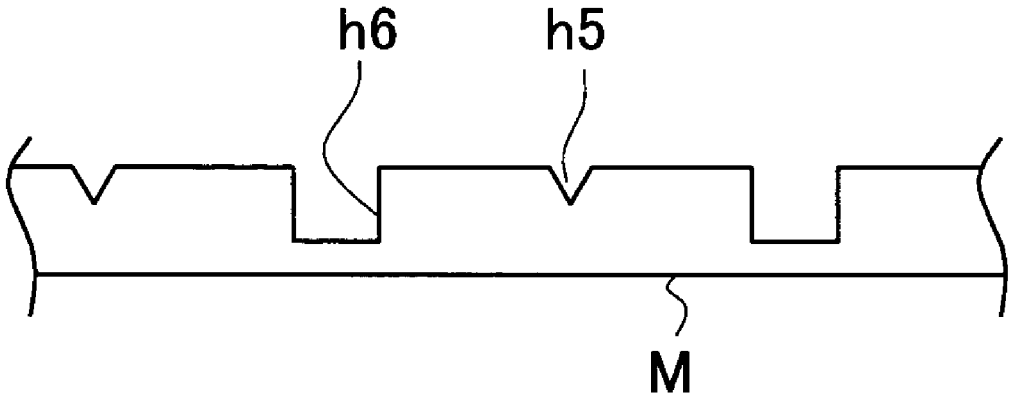
FIG. 9A is a side view showing the situation where grooves are formed in a metal plate by another procedure for manufacturing the first connection terminal according to the embodiment.
Figure 9B:
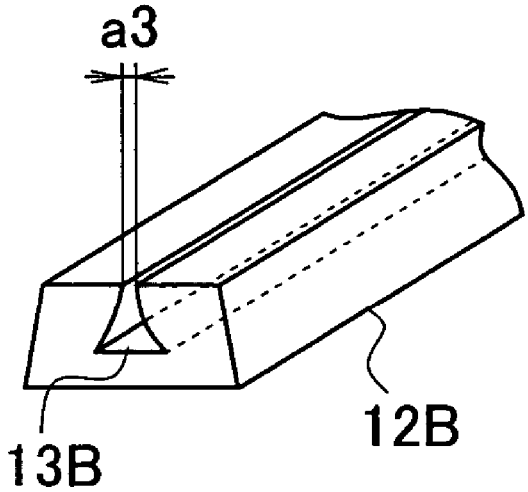
FIG. 9B is a perspective view of another form of the first connection terminal according to the embodiment.

For example, as shown in FIG. 9A, a groove h6 maybe formed to have, in cross section, the general shape of C. When the groove h6 is formed like this, as shown in FIG. 9B, the width of the communicating path 13B may be shaped into a general shape of a trapezoid in cross section, the width of which is a3 at the level of a surface of the first connection terminal 12A, and becomes wider as it is at a level closer to its bottom face.

Third Embodiment

Figure 10A:
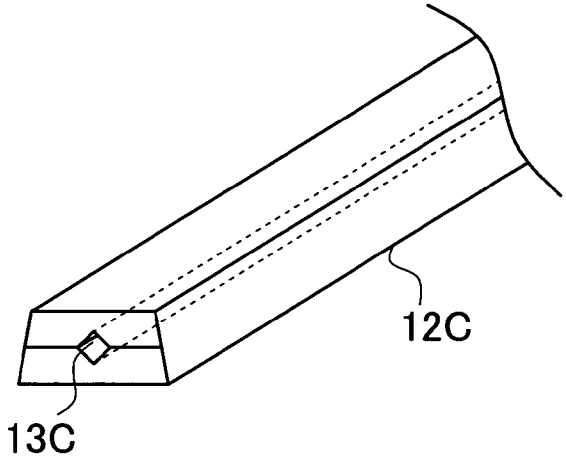
FIG. 10A is a perspective view of each of first connection terminals included by a male connector according to the third embodiment.

FIG. 10A is a perspective view of each of first connection terminals 12C included by a male connector 10 according to the third embodiment.

The embodiment differs from the first embodiment in the structure of the first connection terminals 12C. More specifically, each of the first connection terminals 12C is generally shaped like a rod and has the general shape of a trapezoid in cross section. In the first connection terminal 12C, there is formed a communicating path 13C having a generally-rectangular shape and extending along its longitudinal direction inside the terminal. Incidentally, the communicating path 13C is not limited to this form, and it may have the general shape of, for example, a circle, an ellipsoid, or a rhombus, in cross section.

The above-described first connection terminal 12C can be manufactured according to the following procedures, for example.

First, grooves h7 having the general shape of V in cross section are provided in a surface of each of metal plates M at given intervals by punching (pressworking), cutting, etching, or the like.

Figure 10B:
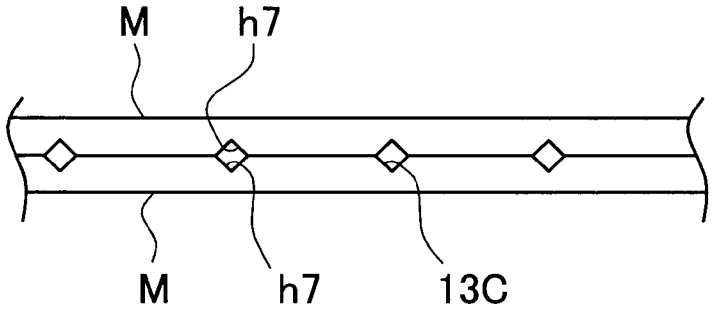
FIG. 10B is a side view showing the situation where grooves are formed in a metal plate by a procedure for manufacturing the first connection terminal according to the embodiment.
Figure 10C:
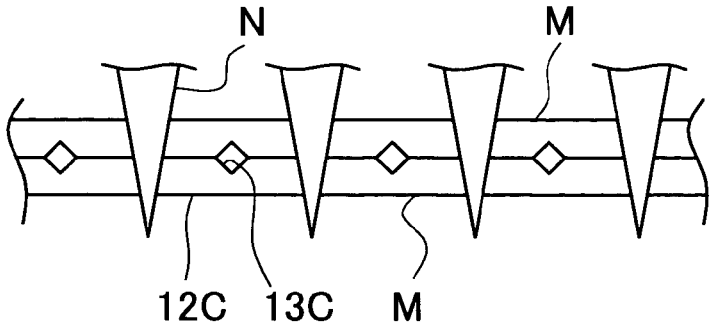
FIG. 10C is a side view showing the situation the metal plate is cut by a procedure for manufacturing the first connection terminal according to the embodiment.

Next, as shown in FIG. 10B, two metal plates M are bonded together by an appropriate adhesive so that the grooves h7 provided in one metal plate face the grooves in the other metal plate, thereby forming the communicating path 13C. Subsequently, as shown in FIG. 10C, a cutting blade N is pressed against the bonded metal plates between the communicating paths 13C thereby to cut the bonded plates M and thus the first connection terminals 12C are formed.

Fourth Embodiment

Figure 11:
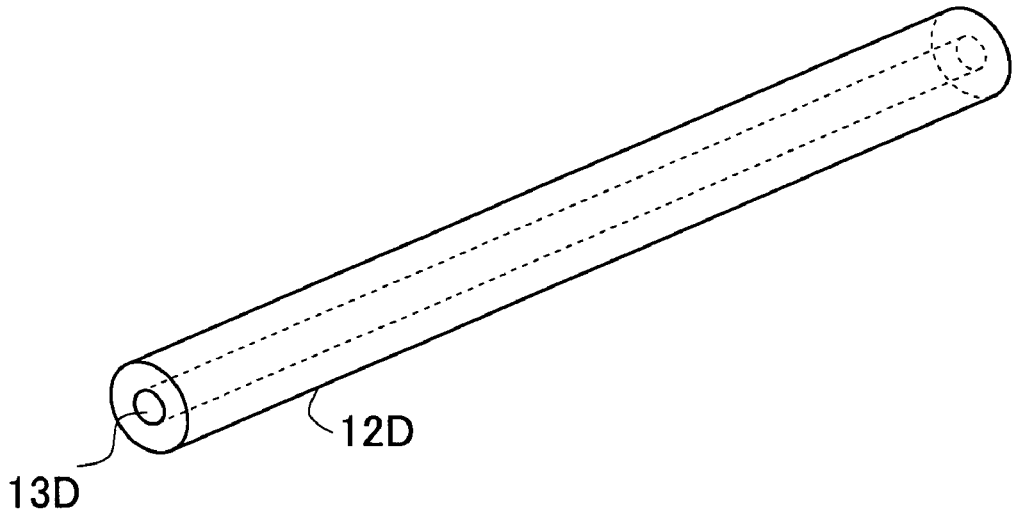
FIG. 11 is a perspective view of each of first connection terminals included by a male connector according to the fourth embodiment.

FIG. 11 is a perspective view of each of first connection terminals 12D included by a male connector 10 according to the fourth embodiment.

The embodiment differs from the first embodiment in the structure of the first connection terminals 12D. More specifically, each of the first connection terminals 12D is shaped like a cylinder. In the first connection terminal 12D, there is formed a communicating path 13D having the general shape of a rectangle in cross section and extending along its longitudinal direction inside the terminal. Such first connection terminal 12D can be formed by drawing the ends of a hollow pipe toward opposite directions to lengthening the pipe, and then cutting the pipe. The inside diameter of the communicating path 13D is preferably 0.01 mm or larger.

The invention is not limited to the above embodiments, and the invention includes modifications and adaptations, which can be made within a scope such that the object of the invention can be achieved.

For example, the first connection terminals 12–12D were manufactured by various methods, however the first connection terminals may be fabricated by a wire-cutting method instead. More specifically, grooves may be formed in a surface of a rod-like member having the general shape of a rectangle in cross section by the wire-cutting method to use the grooves as communicating paths.

In addition, in each of the above embodiments, ventilation of the sealed space Y inside the connector is carried out through the electric wires 22. However, for example, a tube may be additionally provided so as to pierce the female connector housing, thereby making possible to carry out ventilation of the inside of the connector instead.

Further, in the case where the connector of the first embodiment is fixed to a waterproof case and a circuit board is accommodated in the waterproof case, the resulting combination can be utilized as a module with a connector.

Figure 12A:
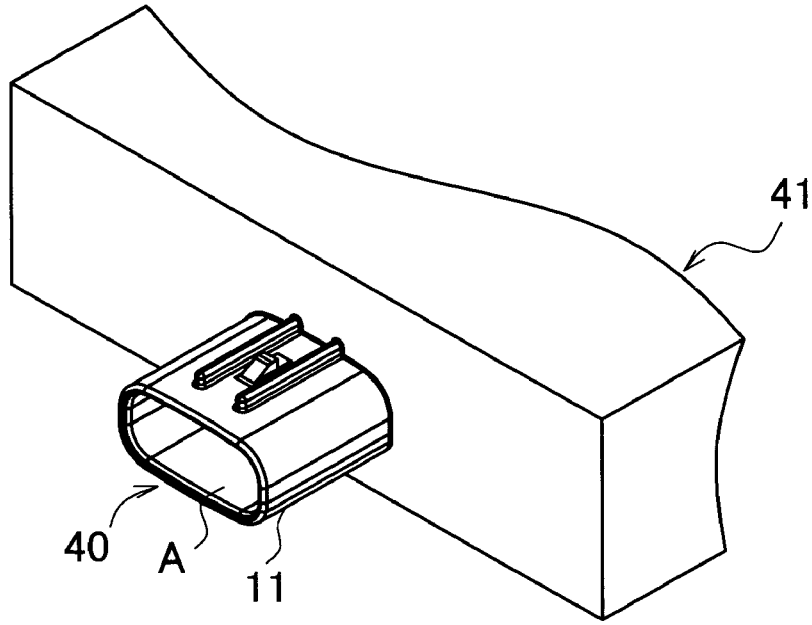
FIG. 12A is a perspective view of a combination of a male connector and sealed case according to an alternative of the invention.
Figure 12B:
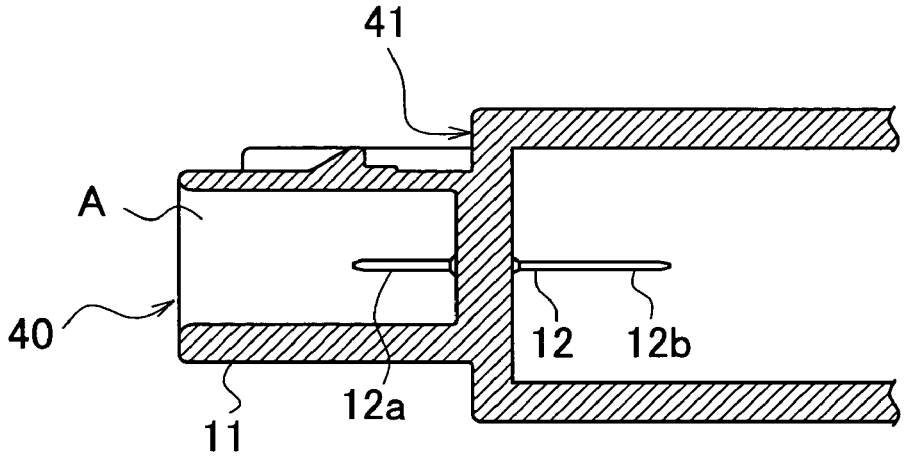
FIG. 12B is a sectional view of the male connector and sealed case according to the alternative.

In each of the above embodiments, the housing 11 of the male connector 10 and the waterproof case 100 as a sealed case are separate structures. However, this isn't necessarily the best way, and the male connector housing and a sidewall of the waterproof case may be formed integrally, as shown in FIGS. 12A and 12B. More specifically, the waterproof case with a connector includes a male connector portion 40 corresponding to the male connector 10 of the first embodiment and a waterproof case portion 41 corresponding to the waterproof case 100 of the first embodiment.

The connector, sealed case with a connector, and module with a connector of the invention have the following advantages.

When the first housing is put inside the second housing, the first connection terminals are inserted in the corresponding second connection terminals, whereby the male connector is connected with the female connector. In this time, a sealed space cut off from the outside is defined inside the connector. The sealed space communicates through the communicating paths with the inside of the sealed case.

Therefore, the inside of the sealed case and the inside of the connector can be opened to the atmosphere through communicating paths and as such, the internal pressure of the sealed case can be brought into a condition close to or agreement with the atmospheric pressure. Accordingly, even when temperature changes cause rapid changes of the internal pressure of the sealed case, the occurrence of a crack in the sealed case can be prevented because the changes of the internal pressure of the sealed case can be relieved.

Moreover, since communicating paths for allowing the inside of the first housing to communicate with the outside are formed in the first connection terminals, the need for additionally providing a communicating path in the first housing is eliminated and therefore the manufacturing cost can be reduced.

What is claimed is:

1. A module with a connector comprising:

a sealed case;

a male connector provided on said sealed case;

a female connector for being connected with said male connector;

wherein said male connector having a generally-box-shaped first housing with an opening formed in its distal end portion, and first connection terminal provided inside said first housing;

wherein said female connector having a generally-box-shaped second housing with an opening formed in its distal end portion, and cylindrical second connection terminal provided inside said second housing;

wherein said first connection terminal has a communicating path formed therein for allowing an inside of said sealed case for communicating with an inside of said first housing;

wherein said female connector has an electric wire for being connected with said second connection terminal;

wherein said electric wire has a plurality of core wires and a cover tube for covering said core wire;

wherein an airway is provided between said core wires and extends along said core wires inside said cover tube to allow an inside of said second housing to communicate with an outside of said second housing; and whereby said first housing is inserted in said second housing so that said first connection terminal is inserted in said second connection terminal, and said male connector is connected with said female connector.

2. The module with a connector of claim 1, wherein said first housing of said male connector is formed integrally with said sealed case.

3. A connector comprising:

a male connector having a generally-box-shaped first housing with an opening formed in its distal end portion, and a first connection terminal provided inside said first housing;

a female connector having a generally-box-shaped second housing with an opening formed in its distal end portion, and a cylindrical second connection terminal provided inside said second housing;

wherein said first connection terminal has a communicating path formed therein for allowing an inside of said first housing for communicating with an outside of said first housing;

wherein said female connector has an electric wire for being connected with said second connection terminal;

wherein said electric wire has a plurality of core wires and a cover tube for covering said core wire:

wherein an airway is provided between said core wires and extends along said core wires inside said cover tube to allow the inside of said second housing to communicate with the outside of said second housing; and whereby said first housing is inserted in said second housing so that said first connection terminal is inserted in said second connection terminal, and said male connector is connected with said female connector.

4. A sealed case with a connector comprising:

a sealed case;

a male connector provided integrally with said sealed case;

a female connector for being connected with said male connector;

wherein said male connector having a generally-box-shaped first housing with an opening formed in its distal end portion, and a first connection terminal provided inside said first housing;

wherein said female connector having a generally-box-shaped second housing with an opening formed in its distal end portion, and a cylindrical second connection terminal provided inside said second housing;

wherein said first connection terminal has a communicating path formed therein for allowing an inside of said sealed case for communicating with an inside of said first housing;

wherein said female connector has an electric wire for being connected with said second connection terminal;

wherein said electric wire has a plurality of core wires and a cover tube for covering said core wire;

wherein an airway is provided between said core wires and extends alone said core wires inside said cover tube to allow the inside of said second housing to communicate with the outside of said second housing; and whereby said first housing is inserted in said second housing so that said first connection terminal is inserted in said second connection terminal, and said male connector is connected with said female connector.

* * * * *